US006161986A

United States Patent [19]

Smith et al.

[11] Patent Number: 6,161,986

[45] Date of Patent: Dec. 19, 2000

[54] AGGREGATE SPREADING APPARATUS AND METHODS

[75] Inventors: Jeffery S. Smith, Chubbuck; Morgan G. Ellis, Pocatello; Randy L. Gardner, Idaho Falls, all of Id.

[73] Assignee: Geff's Manufacturing, Inc., Rexburg, Id.

[21] Appl. No.: 09/096,432

[22] Filed: Jun. 12, 1998

[51] Int. Cl.[7] ..... E01C 19/12

[52] U.S. Cl. ..... 404/75; 404/82; 404/84.05; 222/52

[58] Field of Search ..... 404/84.05, 84.1, 404/84.2, 84.5, 84.8, 94, 75, 82; 222/52

[56] References Cited

U.S. PATENT DOCUMENTS

| | | | |
|---|---|---|---|
| 1,729,574 | 9/1929 | Finley . | |
| 2,793,139 | 5/1957 | Grunewald | 117/93 |
| 3,100,425 | 8/1963 | Cartwright | 94/44 |
| 3,199,423 | 8/1965 | Dickey | 94/44 |
| 3,260,176 | 7/1966 | Bowers | 94/39 |
| 3,279,337 | 10/1966 | Weaver | 94/44 |
| 3,396,644 | 8/1968 | Banks | 94/40 |
| 3,541,933 | 11/1970 | Carpenter | 94/46 |
| 3,677,540 | 7/1972 | Weiss | 222/23 |
| 3,679,098 | 7/1972 | Weiss | 222/23 |
| 3,820,914 | 6/1974 | Zimmerman | 404/110 |
| 3,838,817 | 10/1974 | Hill | 239/125 |
| 3,867,051 | 2/1975 | Bjorhaag | 404/99 |
| 3,877,645 | 4/1975 | Oligschlaeger | 239/155 |
| 4,159,877 | 7/1979 | Jacobson et al. | 366/22 |
| 4,196,827 | 4/1980 | Leafdale | 222/146 H |
| 4,274,586 | 6/1981 | Hill | 239/125 |
| 4,302,128 | 11/1981 | Thatcher | 404/111 |
| 4,311,408 | 1/1982 | Wren | 404/104 |
| 4,322,167 | 3/1982 | Hill | 366/8 |
| 4,350,293 | 9/1982 | Lestradet | 239/155 |
| 4,415,267 | 11/1983 | Hill | 366/14 |
| 4,453,856 | 6/1984 | Chiostri et al. | 404/91 |
| 4,477,203 | 10/1984 | Laditka | 404/111 |
| 4,511,284 | 4/1985 | Sterner | 404/111 |
| 4,523,280 | 6/1985 | Bachman | 364/424 |
| 4,639,103 | 1/1987 | Hill | 350/636 |
| 4,676,690 | 6/1987 | Allen | 404/110 |
| 4,705,125 | 11/1987 | Yamada et al. | 177/25 |
| 4,958,306 | 9/1990 | Powell et al. | 702/40 |
| 5,006,012 | 4/1991 | Sterner | 404/107 |
| 5,015,120 | 5/1991 | Brock et al. | 404/108 |

(List continued on next page.)

OTHER PUBLICATIONS

Advertisement, "W.H. Manufacturing Co. Hi–Tech With Reliability," 1997, U.S.A., W.H. Manufacturing & Sons, P.O. Box 4845, Pocatello, Idaho 83205–4845.

Advertisement, "Spread King The Model WHS Self–Propelled Chip Spreader," pp. 1–7, U.S.A., W.H. Manufacturing & Sons, P.O. Box 4845, Pocatello,, Idaho 83205–4845.

*Primary Examiner*—James A. Lisehora
*Attorney, Agent, or Firm*—Kirton & McConkie; Berne S. Broadbent; Dale E. Hulse

[57] ABSTRACT

An aggregate spreader for spreading a layer of loose aggregate onto a road surface includes a first hopper for receiving the loose aggregate, a plurality of gates or other suitable means associated with the first hopper for dispensing the loose aggregate onto the road surface, a plurality of sensors or other suitable means for sensing characteristics of the road surface, and an electronic controller or other means responsive to the sensors or sensing means and operably associated with the gates or dispensing means for controlling the placement of the layer of loose aggregate onto the road surface. In the preferred embodiment, each of the gates is independently controllable by an associated actuator, and the electronic controller is in electronic communication with the sensing means and in electronic communication with the plurality of actuators for controlling the placement of the layer of loose aggregate onto the road surface by independently controlling each gate of the plurality of gates. The sensing means may be accomplished through many different kinds of devices, including heat sensors, photoelectric sensors, optical sensors, temperature sensors, and the like.

47 Claims, 9 Drawing Sheets

U.S. PATENT DOCUMENTS

| | | | |
|---|---|---|---|
| 5,035,534 | 7/1991 | Brock et al. | 404/81 |
| 5,144,767 | 9/1992 | McCloy et al. | 47/1.7 |
| 5,219,450 | 6/1993 | Thurk | 404/91 |
| 5,232,306 | 8/1993 | Sterner | 404/107 |
| 5,234,128 | 8/1993 | Hill | 222/63 |
| 5,263,790 | 11/1993 | Bickley et al. | 404/107 |
| 5,294,210 | 3/1994 | Lemelson | 404/84.1 |
| 5,364,205 | 11/1994 | Lemelson | 404/72 |
| 5,419,654 | 5/1995 | Kleiger | 404/101 |
| 5,518,544 | 5/1996 | Higginson | 118/315 |
| 5,540,518 | 7/1996 | Wambold | 404/84.05 |
| 5,590,976 | 1/1997 | Kilheffer et al. | 404/72 |
| 5,746,539 | 5/1998 | Mara | 404/84.05 |

136

Calibration Data:

| S1 | S2 | S3 | S4 | S5 | S6 | S7 | S8 | S9 | S10 | S11 | S12 | S13 | S14 | S15 | S16 | S17 | S18 |
|---|---|---|---|---|---|---|---|---|---|---|---|---|---|---|---|---|---|
| | | | | | | | | 898 | | | | | | | | | |

138

One sample of readings:

| S1 | S2 | S3 | S4 | S5 | S6 | S7 | S8 | S9 | S10 | S11 | S12 | S13 | S14 | S15 | S16 | S17 | S18 |
|---|---|---|---|---|---|---|---|---|---|---|---|---|---|---|---|---|---|
| 798 | 804 | 803 | 895 | 895 | 897 | 899 | 902 | 904 | 903 | 898 | 902 | 901 | 905 | 899 | 801 | 796 | 798 |

140

Differences:

| D1 | D2 | D3 | D4 | D5 | D6 | D7 | D8 | D9 | D10 | D11 | D12 | D13 | D14 | D15 | D16 | D17 |
|---|---|---|---|---|---|---|---|---|---|---|---|---|---|---|---|---|
| 6 | 1 | 92 | 0 | 2 | 2 | 3 | 2 | 1 | 5 | 4 | 1 | 4 | 6 | 98 | 5 | 2 |

142

Threshold Difference value: 25 mV

144

Group of sensors:

| S1 | S2 | S3 | S4 | S5 | S6 | S7 | S8 | S9 | S10 | S11 | S12 | S13 | S14 | S15 | S16 | S17 | S18 |
|---|---|---|---|---|---|---|---|---|---|---|---|---|---|---|---|---|---|
| | | | ↓ | ↓ | ↓ | ↓ | ↓ | ↓ | ↓ | ↓ | ↓ | ↓ | ↓ | ↓ | | | |

*Fig. 9*

AGGREGATE SPREADING APPARATUS AND METHODS

BACKGROUND

1. The Field of the Invention

This invention relates to road construction and, more particularly, to novel systems and methods for spreading loose aggregate onto a road surface.

2. The Background Art

Since the cost of roadways is substantial, it is desirable to lengthen the useful life of a road as much as possible. To make roads last longer, they are sometimes treated for preventive maintenance. Preventive maintenance of a road surface can reduce the likelihood of the road surface becoming cracked or chipped, having potholes appear, and developing other similar problems that often occur with roads.

There are several ways that road surfaces can be treated to help lengthen the life of the roadway. Chip seals, also known as oil and screenings, aggregate seal coats, and armor coats, are surface treatments which are placed on an existing asphalt pavement. Applying a chip seal to a road is one form of preventive maintenance that can be used to increase the life of a roadway. Generally, the chip seals do not add structural strength to the roadway, but they do produce an ideal all-weather surface, renew weathered pavement, improve skid resistance, and seal the old pavement.

Chip seals are applied to a roadway by first spraying the pavement with a binder, often an asphalt emulsion, from an oil distributor truck. This binder is a tacky coating placed onto the road surface that acts to bind gravel, to be applied soon thereafter, to the road surface. After the binder is applied to the road surface, a uniform application of cover aggregate (similar to and including fine gravel) is applied, usually by a self-propelled chip spreader. For example, chip seals usually employ ¼ to ½ inch (0.64 to 1.3 cm) aggregate. As the aggregate (i.e., gravel) contacts the sticky binder coat, it tends to stick to the road surface. The aggregate is usually rolled as soon as possible to ensure the adhesion of the aggregate to the binder and pavement surface.

When aggregate is spread onto a road surface where there is no binder, the aggregate will not stick to the road, but remains as loose gravel on the road. Of course, such loose gravel can create several problems on a roadway.

When aggregate is laid down where there is no binder, the aggregate tends to be wasted because it is not being used as part of the chip seal as it was intended. Thus, the more aggregate that is spread over surfaces without binder, the more aggregate is wasted during the chip sealing operation.

Aggregate not bound to the road surface by a binder is free to be moved, and sometimes flipped upwards by traffic. When this loose aggregate is flipped upwards by cars it can cause damage to traffic nearby. For example, a piece of aggregate flipped upward could hit and crack a windshield, or chip the paint of the vehicle. Flipped aggregate could also hit and injure a pedestrian.

If a substantial amount of aggregate were placed on the roadway such that it was loose and not bound to the road by binder, car accidents could be caused. For example, if a car hit a large portion of loose aggregate at high speed, it could swerve out of control and collide with oncoming traffic, an embankment, pedestrians, etc.

Often a chip seal cannot be applied to an entire roadway at one time but requires two or more passes. For example, for a two-lane highway, often one lane will be chip sealed, and then the other lane will be chip sealed thereafter. In such cases, the first lane will usually have binder applied to it, and after that the chip spreader travels down that lane applying aggregate. Thereafter, the second lane is chip sealed in similar fashion.

Before the chip sealing process can be applied, the road surface needs to be substantially free of loose aggregate. Sometimes, while spreading aggregate on one lane which has had the binder applied, excess aggregate can be inadvertently spread onto the other lane that does not yet have binder applied. Several factors can contribute to this. The binder may simply have not been applied properly in some areas. Alternatively, at times, chip spreader operators must maneuver the chip spreader in a way that may cause the aggregate to be applied where the binder is not. An example of this is when an aggregate spreader operating in a rural area must steer so as to avoid a mailbox.

If loose aggregate is found on the lane not yet chip sealed, the aggregate must be cleared off before the binder coat can be applied. This requires additional labor. Often the aggregate is removed by manual laborers using sweepers. A mechanized sweeper could also be used. In any event, misapplied aggregate often requires additional cost and time in cleaning up the excess or misapplied aggregate.

Not only are there problems when aggregate is applied where there is no binder, but there are problems when no aggregate is applied over binder. Bare binder on a road surface is quite tacky, and often causes vehicles passing over the roadway to have portions of the binder flipped onto them. As many drivers are aware, this binder substance is difficult to get off of a vehicle.

Chip spreaders are complex vehicles to operate. In addition, as discussed, if a chip spreader is not operated and driven correctly, excess aggregate can be spread, causing several possible problems. Because of this, often few members of a road construction crew are qualified to operate a chip spreader. A substantial amount of investment in training and experience is required before an aggregate spreading operator is well qualified.

BRIEF SUMMARY AND OBJECTS OF THE INVENTION

In view of the foregoing, it is a primary object of the present invention to provide an aggregate spreader capable of selectively placing aggregate onto a road surface.

Another object of the present invention is to provide an aggregate spreader that automatically and selectively places aggregate onto a road surface.

It is also an object to substantially avoid spreading aggregate onto portions of a road surface not having a binder applied thereto.

Another object of the present invention is to minimize aggregate waste when spreading aggregate onto a roadway.

A further object of the present invention is to reduce the likelihood of injury or damage arising from placing loose aggregate onto a road surface.

An additional object is to reduce the cost and time required in spreading aggregate by reducing the labor of cleaning off misapplied aggregate.

A still further object of the present invention is to reduce the likelihood of leaving bare binder, often asphalt emulsion, on the road surface.

Another object is to reduce the skill and experience required by aggregate spreader operators.

Consistent with the foregoing objects, and in accordance with the invention as embodied and broadly described herein, an aggregate spreader for spreading a layer of loose aggregate is disclosed in one embodiment of the present invention as including a first hopper for receiving the loose aggregate, means associated with the first hopper for dispensing the loose aggregate onto the road surface, means for sensing characteristics of the road surface, and means responsive to the sensing means and operably associated with the dispensing means for controlling the placement of the layer of loose aggregate onto the road surface.

In the preferred embodiment, the dispensing means includes a plurality of gates. Each of the gates is independently controllable by an associated actuator, and the preferred controlling means, an electronic controller, is in electronic communication with the sensing means and in electronic communication with the plurality of actuators for controlling the placement of the layer of loose aggregate onto the road surface by independently controlling each gate of the plurality of gates. The sensing means may include many different kinds of devices, including heat sensors, photoelectric sensors, optical sensors, temperature sensors, and the like.

BRIEF DESCRIPTION OF THE DRAWINGS

The foregoing and other objects and features of the present invention will become more filly apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 9 is a data diagram representing possible values that may be encountered in implementing the flow diagram of FIG. 8.

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 9, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
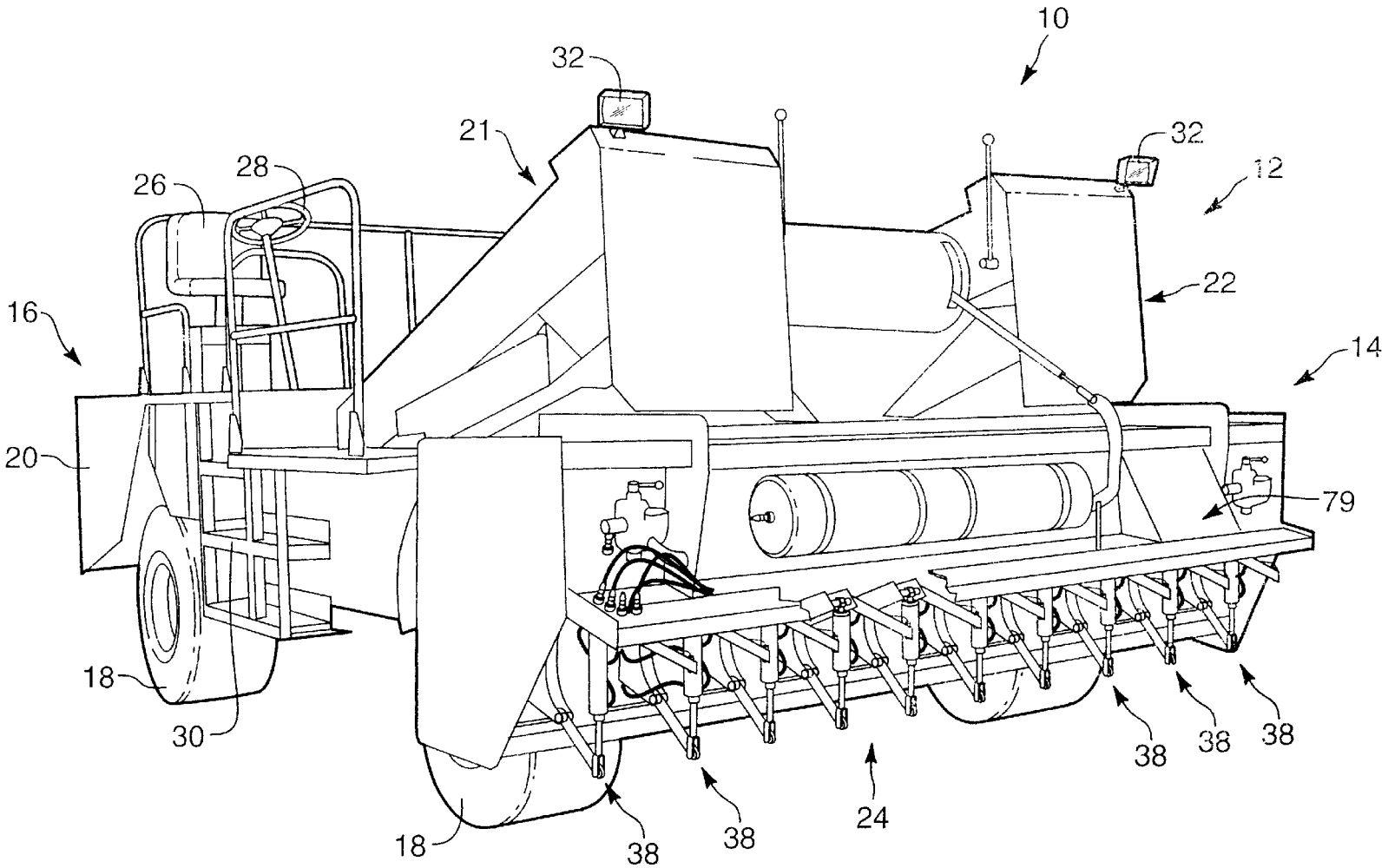
FIG. 1 is a perspective view of one presently preferred embodiment of an aggregate spreader within the scope of the present invention, with part of the first hopper being cut away to more filly show the aggregate delivery mechanism.

As shown in FIG. 1, an aggregate spreader 10 for spreading loose aggregate onto a road surface includes a first hopper 12 for receiving the loose aggregate, means associated with the first hopper 12 for dispensing the loose aggregate onto the road surface, means for sensing characteristics of the road surface, and means responsive to the sensing means and operably associated with the dispensing means for controlling the placement of the layer of loose aggregate onto the road surface.

The aggregate spreader 10 has a front end 14 and a back end 16. In the presently preferred embodiment, the first hopper 12 is positioned proximate the front end 14 of the aggregate spreader 10. The first hopper 12 is so positioned because it is preferable to spread the loose aggregate onto the road surface before driving the wheels 18 of the aggregate spreader 10 thereover. Before the aggregate is spread, in typical chip sealings, a binder is first applied to the road surface. This binder, usually an asphalt emulsion, is usually quite tacky. Thus, if the wheels 18 of the aggregate spreader 10 were to drive over the binder before the aggregate was spread, the wheels 18 could become quite tacky themselves and would likely become covered by aggregate and other like material. To avoid this potential problem, the aggregate is usually spread in front of the wheels 18 of the aggregate spreader 10.

In current design, the aggregate spreader 10 also includes a second hopper 20 for receiving the loose aggregate from another source. The second hopper 20 is positioned at the back end 16 of the aggregate spreader 10. Typically, a truck (not shown) carrying loose aggregate backs up to the back end 16 of the aggregate spreader 10 and proceeds to lift the truck bed so that the loose aggregate begins to flow into the second hopper 20. In operation, conveying means conveys the loose aggregate from the second hopper 20 to the first hopper 12. In the presently preferred embodiment, the conveying means comprises a conveyor belt system 21. Thus, one or more conveyor belts serve to convey loose aggregate from the second hopper 20 to the first hopper 12.

The presently preferred embodiment of first hopper 12 includes a head baffle 22. The head baffle 22 serves to deflect the loose aggregate down toward dispensing means of the first hopper 12. For example, when the conveyor system 21 is operating at a high speed, the head baffle 22 serves to focus the loose aggregate downward. Without the head baffle 22 in place, when the conveyor belt system 21 is operating at high speed, some loose aggregate may not be delivered down through the first hopper 12, but may be projected over the first hopper 12 because of the momentum provided to the loose aggregate by the conveyor system 21.

The dispensing means associated with the first hopper 12 includes a delivery mechanism 24 for dispensing aggregate to the road surface. The presently preferred embodiment of the dispensing means employs a plurality of gates 38.

Those of skill in the art will appreciate that many chip spreaders used today are self propelled. The spreader 10 of FIG. 1 is also self propelled. A chip spreader 10 that is self propelled may pull a dump truck behind it as it proceeds down a road spreading loose aggregate. The presently preferred embodiment of the aggregate spreader of the present invention, as illustrated in FIG. 1, is self propelled to provide this feature. However, it will be appreciated that the present invention could be implemented on a chip spreader that is not self propelled.

The chip spreader (of aggregate spreader) 10, as generally described and illustrated in FIG. 1 includes many standard parts and features of chip spreaders in general. From a driver's seat 26, a driver (not shown) may operate the chip spreader 10 through a steering wheel 28 and other operational controls (not shown). Steps 30 may be provided to facilitate a user climbing onto the chip spreader 10. Headlights 32 may be provided on the head baffle 22. Other standard features of chip spreaders may also be found on the chip spreader 10 of FIG. 1. The chip spreader manufactured by Geffs Manufacturing Inc. and known as the WHS Spread King includes such standard features and elements. The WBHS Spread King is a larger chip spreader that also includes these elements and features. Those of ordinary skill in the art will be familiar with and appreciate the standard features and elements provided on commercially available aggregate spreaders, which may also be provided on an aggregate spreader within the scope of the present invention. Accordingly, the following discussion of the remaining FIGS. 2–9 will particularly emphasize those elements and features needed to understand the structure, use and/or operation of the present invention.

Figure 2:
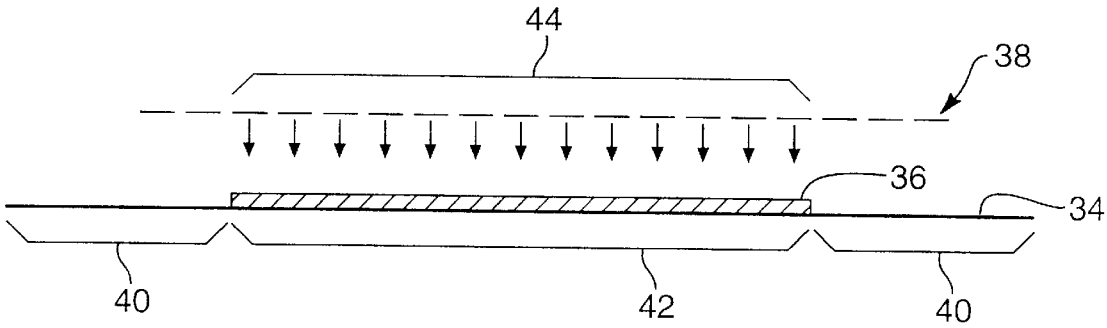
FIG. 2 is a schematic cross-sectional diagram of a road surface having a span of binder applied thereon and illustrating the operation of one presently preferred embodiment of the present invention.

As discussed earlier, when aggregate is spread over parts of the road that do not have binder applied, many problems and consequences can result. The present invention helps solve this problem. FIG. 2 is a schematic cross-sectional diagram of a road surface 34 having a span 36 of binder applied thereon.

The dispensing means dispenses the loose aggregate from the first hopper 12 onto the road surface. The presently preferred dispensing means is a plurality of gates 38, as shown in FIG. 1. The gates 38 are shown schematically in FIG. 2. As illustrated in FIG. 2, there are eighteen gates 38. Of course, it will be appreciated by those skilled in the art that any practical number of gates 38 could be used in implementing the present invention.

The sensing means locates the binder on the road surface 34. This may be done by sensing characteristics of the road surface 34 or by sensing the position of the binder through other means. If the road surface 34 is being used to determine the location of the binder, depending upon the type of sensing means being used, there are various characteristics that could be detected by the sensing means. Characteristics that may be sensed include, but are not limited to, heat, color, consistency, thickness, reflectivity, resistance, capacitance, conductance, magnetic properties, and chemical properties. This list is by no means exhaustive. Later, various sensors will be listed that could be used with the present invention. Many different types of sensors could be used with the present invention. If the sensing means is being used to analyze the road surface 34 and locate the binder from such an analysis, the sensing means needs to be able to distinguish, in any way, between portions 42 of a road surface 34 having binder 36 applied thereon and portions 40 of the road surface 34 free of any binder 36.

The road surface 34 shown in FIG. 2 has a portion 42 with binder 36. The rest of the road surface 34 does not have binder 36 applied. The presently preferred embodiment of the present invention operates to dispense loose aggregate onto the binder 36 and avoids dispensing aggregate onto the bare road surface portions 40 by sensing the location of the applied emulsified asphalt binder 36. The sensing means and controlling means will sense the binder 36 on the middle portion 42 of the roadway 34. In addition, the present invention will detect those portions 40 of the roadway 34 not having binder 36 applied thereon. Responsive to this information and determination, the present invention will cause the loose aggregate to be dispensed substantially only on the portion 42 of the roadway 34 having binder 36. The manner in which the presently preferred embodiment of the invention accomplishes the sensing means and related calculations will be more fully discussed in relation to FIGS. 4–9.

As mentioned, the presently preferred dispensing means employs gates 38. Accordingly, the controlling means will control the gates 38 positioned over the binder 36 so that the appropriate section 44 of gates 38 will dispense aggregate onto portions 42 of the road 34 having binder 36 and will cause the gates 38 not over binder 36 to remain closed. Arrows in FIG. 2 represent the loose aggregate being dispensed only from certain gates 38 located over the portion 42 of the roadway 34 having binder 36.

Figure 3:
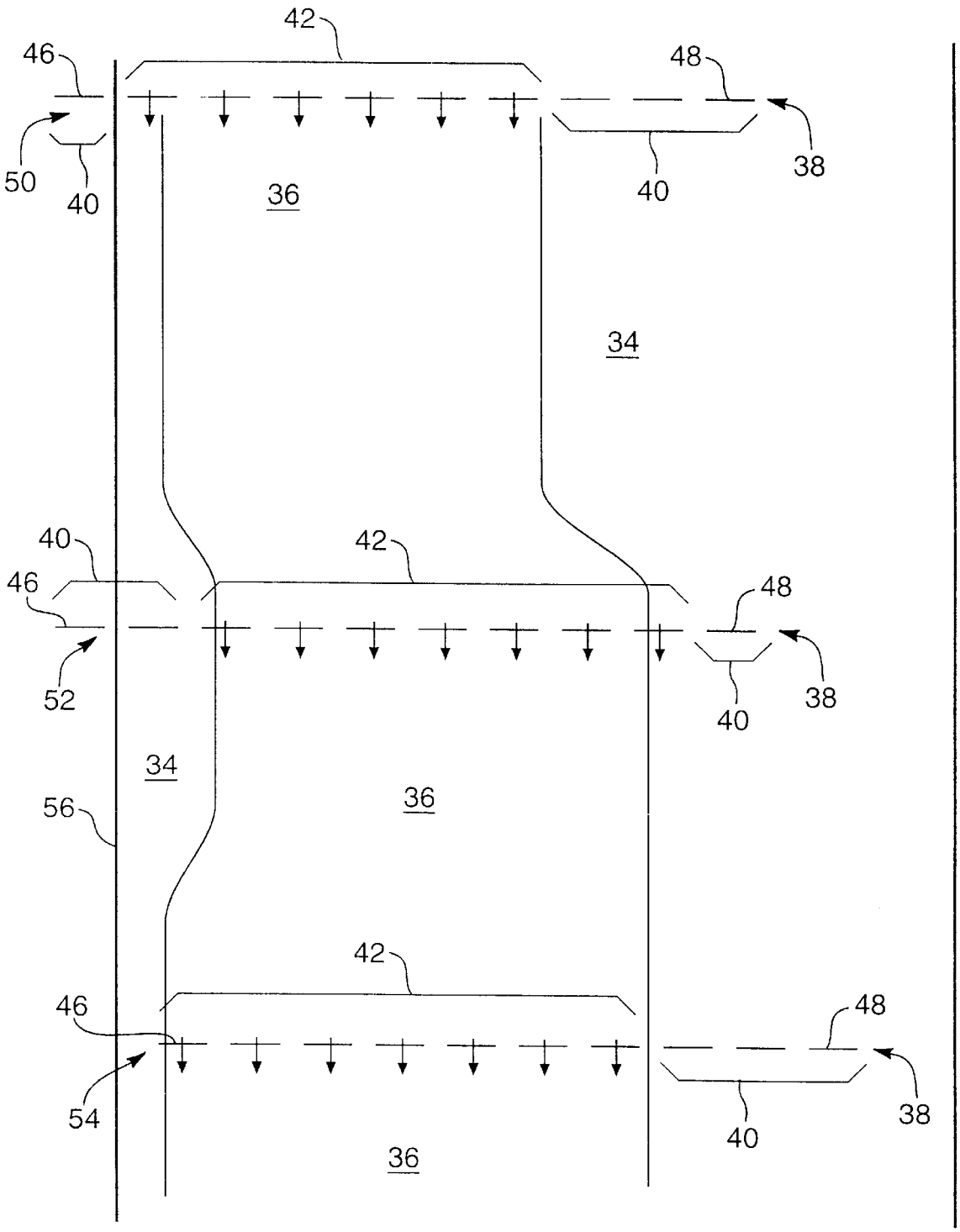
FIG. 3 is a schematic top plan diagram of a road surface having a span of binder applied thereon and illustrating the operation of one presently preferred embodiment of the present invention.

FIG. 3 is a schematic top plan diagram of a road surface 34 having binder 36 thereon. As described further below, the diagram also indicates where an aggregate spreader 10 made in accordance with the present invention would be spreading aggregate. As illustrated in FIG. 3, the aggregate spreader includes only ten gates 38, including end gates 46 and 48.

As shown in FIG. 3, and as assumed for purposes of the following discussion, the binder layer 36 applied to roadway 34 has a continuous (although not a constant) width. In other words, at any point along roadway 34, the width of the applied binder layer 36 can be represented as a single, continuous line segment. As a practical matter, making such an assumption simplifies the operation and explanation of the present invention. It will be appreciated, however, that such an assumption need not be made. For example, binder may be applied to a roadway in the form of two or more strips, thereby creating a binder layer with a non-continuous width. It will be appreciated that the aggregate spreader of the present invention may also be employed to place aggregate on a binder layer not of a continuous width. The principles used to accomplish such an alternative application of aggregate would be the same as those described in detail herein, and those skilled in the art will readily appreciate how the presently preferred embodiment can be modified to achieve such an implementation.

In FIG. 3, three snapshots of the operation of the present invention are shown. The view of FIG. 3 is a schematic top plan view of a roadway 34, and each sample was taken at particular point along the roadway 34. As the aggregate spreader 10 travels down the roadway 34, the first sample 50 was taken first in time, the next sample 52 was taken at some point further down the roadway 34 and later in time, and the third sample 54 was at an even later place and time down the roadway 34. The arrows associated with each of samples 50, 52 and 54 illustrate the gates 38 that are open to dispense aggregate. Thus, the first sample 50 (or snapshot 50) shows that six of the ten gates 38 are open to dispense aggregate onto the binder layer 36.

In the presently preferred embodiment, a plurality of sensors are used to achieve the sensing means. In current design, there is one sensor for each gate 38. In sample 50, the sensor signals from six gates 38 would have been grouped together into a group 42 and determined to be over binder 36 by the controlling means. The remaining four gates (including gate 46 and the three gates adjacent gate 48), were determined to be in a group 40 over nonbinder.

At the second sample 52, again, the sensor signals, and effectively the gates 38, were grouped into two groups. The first group 40 includes three gates 38 (the two gates adjacent gate 46 as well as gate 48). The binder group 42 includes the remaining seven gates 38. The change in the location of the binder 36 from sample 50 to sample 52 illustrates how the present invention will automatically adjust the dispensing means so that aggregate is dispensed substantially over binder 36 only. Interaction from the operator was not required to adjust the gates 38 as they are shown from sample 50 to sample 52.

The third sample 54 shows the aggregate spreader in a different position relative to the edge 56 of the roadway than in samples one 50 and two 52. This may happen under several circumstances. Perhaps the operator steered the aggregate spreader so as to avoid a mailbox or similar obstruction on the side of the road. Alternatively, an operator could have just inadvertently steered the aggregate spreader more toward the center of the roadway 34. As shown at sample 54, the gates 38 are again grouped into two groups. The signals coming from the sensors above the seven gates 38 adjacent gate 46 were determined to be above binder 36 and were grouped into a binder group 42. The remaining three gates including gate 48 were determined to not be over binder. Thus, unlike the groupings 40 discussed above in connection with samples 50 and 52, the grouping 40 of gates 38 associated with sameple 54 is closed.

FIG. 3 illustrates how, as the location and/or width of the binder layer 36 varies, the presently preferred embodiment of the present invention will automatically close and/or open appropriate gates 38 to apply loose aggregate to the binder portion 36 without applying loose aggregate where there is no binder. Of course, because of the limitations of gate size, some extra aggregate may be placed through gates having both binder 36 and nonbinder surfaces underneath. To be more specific, it is possible that a portion of the roadway under a particular gate 38 and its accompanying sensor would be mostly binder 36, but not all binder 36. Accordingly, the gate 38 would likely be opened to dispense aggregate because most of the area under the sensor was covered with binder 36. However, because not all of the area was binder 36 some aggregate will be placed onto the bare roadway 34. As the gate 38 size is reduced and as the sensor capability is improved, these mechanical limitations could be designed to be smaller and smaller.

Thus far the present invention has often been described in general terms. Accordingly, one skilled in the art could take the principles as found herein and practice the present invention through various and disparate ways. Through FIGS. 4 through 9 more specificity to the presently preferred embodiment will be given.

Figure 4:
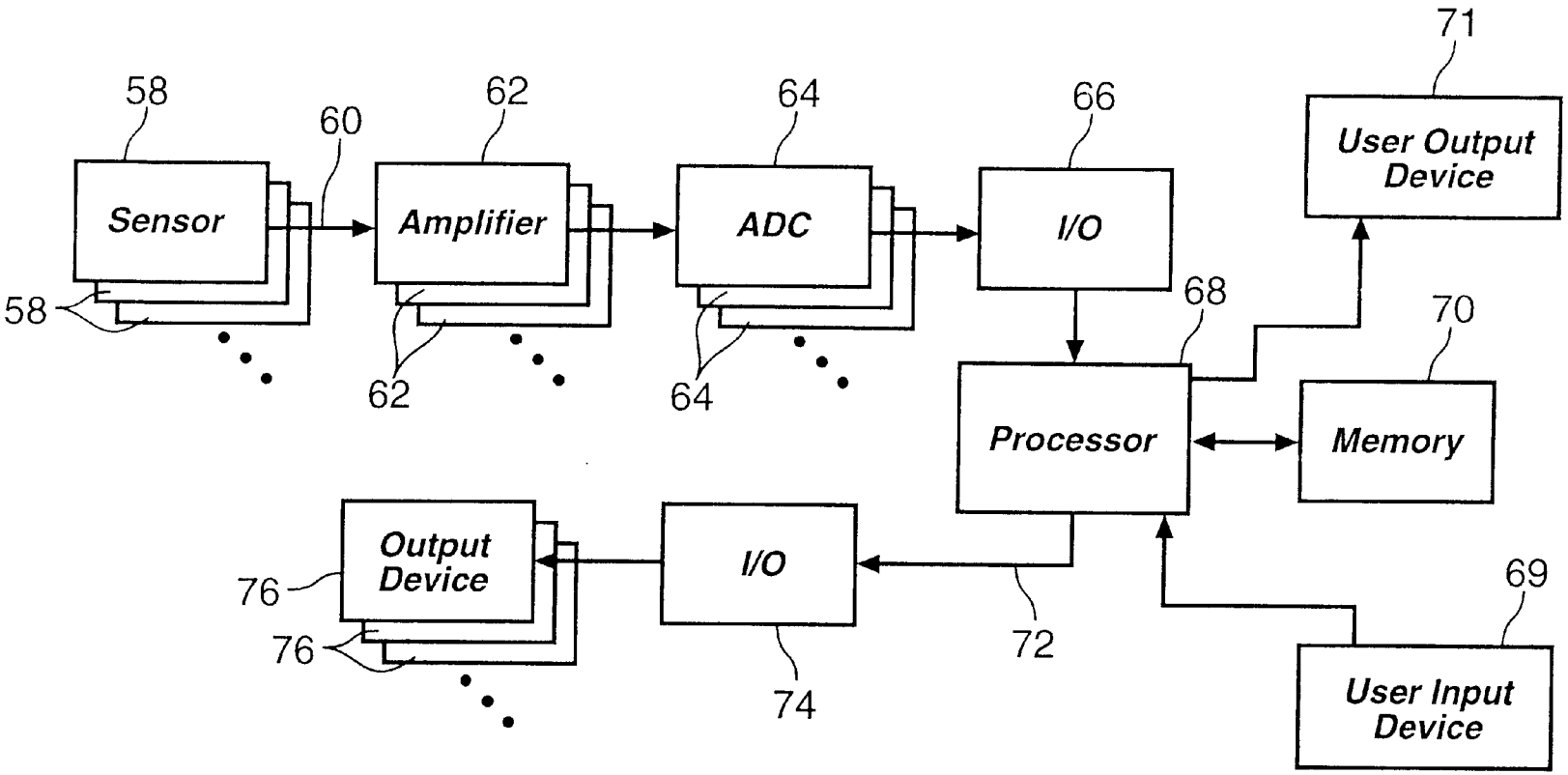
FIG. 4 is a general block diagram of one presently preferred embodiment of the present invention.

FIG. 4 illustrates a general block diagram of the presently preferred embodiment of the present invention. As shown in FIG. 4, the sensing means may be accomplished through a sensor 58. The sensor 58 may be any type of sensor capable of determining where the binder is positioned on the roadway. In current design, the output signal 60 from the sensor 58 is amplified by an amplifier 62. After being amplified, the signal 60 from the sensor is converted from an analog signal to a digital signal by an Analog to Digital Converter (ADC) 64. After being converted to a digital signal, the sensed signal is fed into a processor 68 through an Input/Output (I/O) port 66.

FIG. 4 also indicates that several sensors 58 are used in the presently preferred embodiment. Each additional sensor 58 used the preferred embodiment also includes an additional amplifier 62 and an additional ADC 64. These components, in current design, are electronically connected as shown by the interconnections of the labeled blocks.

Once the processor 68 has read in the signals, processor 68 may make a decision as to which parts of the dispensing means should dispense loose aggregate and which parts of it should not. Typically processor 68 has memory 70 operably connected thereto. Many different components may also be in electronic communication with the processor 68. For example, a user input device 69, such as a keypad, a keyboard, switches, and the like, may be operably connected to the processor 68 so that the an operator of the chip spreader 10 can input data to the processor 68. In addition, user output devices 71, such as a monitor, an LCD, LEDs, and the like, may also be operably connected to the processor 68 for sending output to the operator. The presently preferred user input device 69 includes several means for entering inputs including keypads, switches, and buttons. Other inputs may be fed into the processor as required. For example, a radar speed sensor and a gate position sensor could both be operably connected to the processor. The presently preferred user output device 71 is an LCD.

Once the processor 68, or similar means, decides which part of the dispensing means should be dispensing loose aggregate, processor 68 may direct the dispensing means to achieve its decision. To do this, the processor 68 may send an output signal 72 through an I/O port 74 to an output device 76. In the presently preferred embodiment, as discussed, the dispensing means comprises a plurality of gates 38. Accordingly, in current design, the output device 76 is an actuator for opening and/or closing a particular gate 38. There is one output device 76 for each gate 38.

It will be appreciated by those skilled in the art that a variety of components could be added to or deleted from the general block diagram of FIG. 4 without detracting from the scope of the present invention. For example, if the sensor 58 gave as an output a signal capable of being transmitted to the ADC 64 that was already within the specified ranges of input for the ADC 64, there may be no need for the amplifier 62. Moreover, some sensors could be used that have digital output signals. If these types of sensors are used, the output from the sensor 58 could be fed directly into the processor 68 through the I/O port 66.

There are many different devices that could be used to accomplish the sensing means. As discussed, the sensing means needs to be able to determine where the binder is located on a roadway. Presently, sensors capable of sensing characteristics of the road surface 34 are used to achieve the sensing means. Generally speaking, different types of sensors that may be used with the present invention include contact-type sensors and non-contact type sensors.

Non-contact sensors do not need to actually touch the road surface 34 in order to detect whether there is binder. There are many different kinds of non-contact sensors that could be used. Following is a list of some of the non-contact sensors that may be used. The following sensors are meant only as an illustration of some of the sensors that could be used; it is not an exhaustive list. Any sensor capable of detecting the binder on the road surface, or detecting the location of the binder, by any means could theoretically be used. The presently preferred sensor 58 will be shown and discussed with FIGS. 5 and 6. These types of sensors 58 shown in FIGS. 5 and 6 have been tested and proven to satisfactorily accomplish the function required by the sensing means. The other types of sensors to be briefly discussed could theoretically be used. However, whether all these sensors would be practical to use in implementing the present invention is a question that would need to be addressed by those skilled in the art who are implementing those particular sensors with the present invention. The following brief description of the different types of sensors available is meant to show what types of sensors are available and could possibly work in theory and/or in practice with the present invention.

Ultrasonic sensors could be used. This type of sensor could possibly sense the differences in the distances to the road surface and to the top of the layer of emulsified asphalt on it. Another type of sensor that could be used is a hydrocarbon sensor. This type of sensor could possibly sense the emission of hydrocarbons from the petroleum based emulsified asphalt binder.

A photoelectric sensor could be used. For example, a photoelectric sensor could be used to measure the reflectivity of the surface. The layer of emulsified asphalt would likely have a high reflectance due to its glossy surface. This reflectance would typically be different than the reflectance of the existing road surface. Because of this difference in reflectance the difference between the binder portion and the bare road may be obtained through use of photoelectric sensors.

A capacitive sensor could be used with the present invention to sense road characteristics. The capacitive sensor senses a change in capacitance between two electrodes which are part of the sensor.

Another sensor that could be used is a humidity sensor. This type of sensor could possibly sense the increased humidity due to the water vapor in the air above the emulsified asphalt.

A video image type of sensor could be used. A video sensor could sense a video image of the road surface, and a controller could determine the location of the emulsified asphalt due to the color differences. In addition, the video sensor could also be used to sense the location of distributor truck application nozzles or spray patterns and predict the location of the emulsified asphalt. When chip sealing, the distributor truck spraying the binder on the roadway is typically only a short distance ahead of the aggregate spreader 10. For this latter video sensor application, the video sensor would be trained on the tail end of the distribution truck. Accordingly, in this embodiment the sensing means is not directly sensing characteristics of the road surface, but is receiving information from which the location of the binder could be determined. Sensing means of this type which indirectly obtain the location of the binder are also contemplated by the present invention.

A laser sensor could be used with the present invention. This type of sensor could possibly detect the raised layer of emulsified asphalt on the road surface. Moreover, oxygen/gas sensors could possibly sense different levels of oxygen and other gases above the emulsified asphalt.

Another way that asphalt binder could be detected is by adding a chemical additive to the emulsified asphalt before it is applied to the road surface. Then a sensor could sense the chemical based properties of the chemical. Similarly, and in the alternative, a material could be added to the emulsified asphalt before its application to the road surface that would add a magnetic property to the binder. Then a sensor could detect the binder because of its magnetic and/or metallic properties.

Another way that the sensing means could sense where the binder was is by having the distribution truck distributing the emulsified asphalt transmit the position of the binder distribution. This could be done in several ways. One way in which this could be accomplished is by placing transmitters on the distribution truck and having them transmit information regarding which sprayers on the distribution truck are spraying and which are not. The aggregate spreader could receive this information and from it predict the location of the emulsified asphalt. The transmission may include GPS information. If GPS was used, the information transmitted may indicate where the binder was through GPS coordinates. This is another example of an embodiment where the sensing means is not directly sensing characteristics of the road surface, but is receiving information from which the location of the binder could be determined. Sensing means of this type which indirectly obtain the location of the binder are contemplated by the present invention.

Sensors that sense magnetic disturbances could also be used. Sensors could theoretically be used that sense disturbance in the magnetic field of the earth due to masses moving in close proximity. The masses could possibly include either the emulsified asphalt distributor or the emulsified asphalt itself.

Besides the non-contact sensors, contact types of sensors could be used. Contact types of sensors generally require some contact between the sensor and the item being analyzed. Different kinds of contact sensors could theoretically be used in practicing the present invention. A resistive sensor could include probes contacting the road surface. The resistance between each probe could be measured and dramatic increases in resistance could indicate one probe contacting emulsified asphalt and the other not contacting emulsified asphalt.

A PH sensor could be used. This type of sensor could sense the PH level of the surface with a contact probe. The emulsified asphalt should have a different PH level than the existing road surface.

Mechanical slippage could be used with the present invention. A wheel could be placed on the aggregate spreader so that it rolls on the road surface. A sensor could be used to sense whether the wheel is rolling or slipping. If the drag on the wheel is set appropriately, when the wheel runs into emulsified asphalt it may slip. In this way the binder could be detected through mechanical slippage.

A contact type of sensor could be used to measure the temperature of the surface. Probes could be used to measure the temperature of the surface. This type of sensor could work in a fashion similar to the presently preferred embodiment of the infrared thermocouples in that the sensor would be sensing temperature and/or heat.

The foregoing enumeration of different types of sensing means that could be used with the present invention illustrate the broad scope of the sensing means element. As discussed, the sensing means operates in such a way so as to either directly or indirectly locate the position of the binder 36 on the road surface 34.

The output device 76 of FIG. 4 is used to control the placement of the loose aggregate onto the road surface 34. Depending upon the type of dispensing means used, many different types of output devices 76 could be used to control the dispensing means. The dispensing means may be a plurality of gates 38, as shown in FIG. 1. In the presently preferred embodiment, each of the gates 38 is independently controllable by an associated means for actuating said gate. The presently preferred actuating means includes a plurality of air cylinders with associated air solenoids. The compartment 79 for the air solenoids is shown in FIG. 1 on the front end 14 of the aggregate spreader 10. In current design, all solenoids are located within this compartment 79.

Other dispensing means could be used in practicing the present invention. For example, a plurality of discrete outlets could be used to implement the dispensing means. In addition, the dispensing means could be implemented with one variable width outlet.

The processor 68 of FIG. 4 achieves the controlling means. The controlling means is responsive to the sensing means and operably associated with the dispensing means for controlling the placement of the layer of loose aggregate onto the road surface. The controlling means may be implemented in a variety of ways. The controlling means could be a processor, a controller card commercially available, a microcontroller, a fully functional computer, a set of discrete components designed to accomplish the present invention, an application specific integrated circuit (ASIC), or the like. The presently preferred controlling means will be discussed in relation to FIG. 5.

Figure 5:
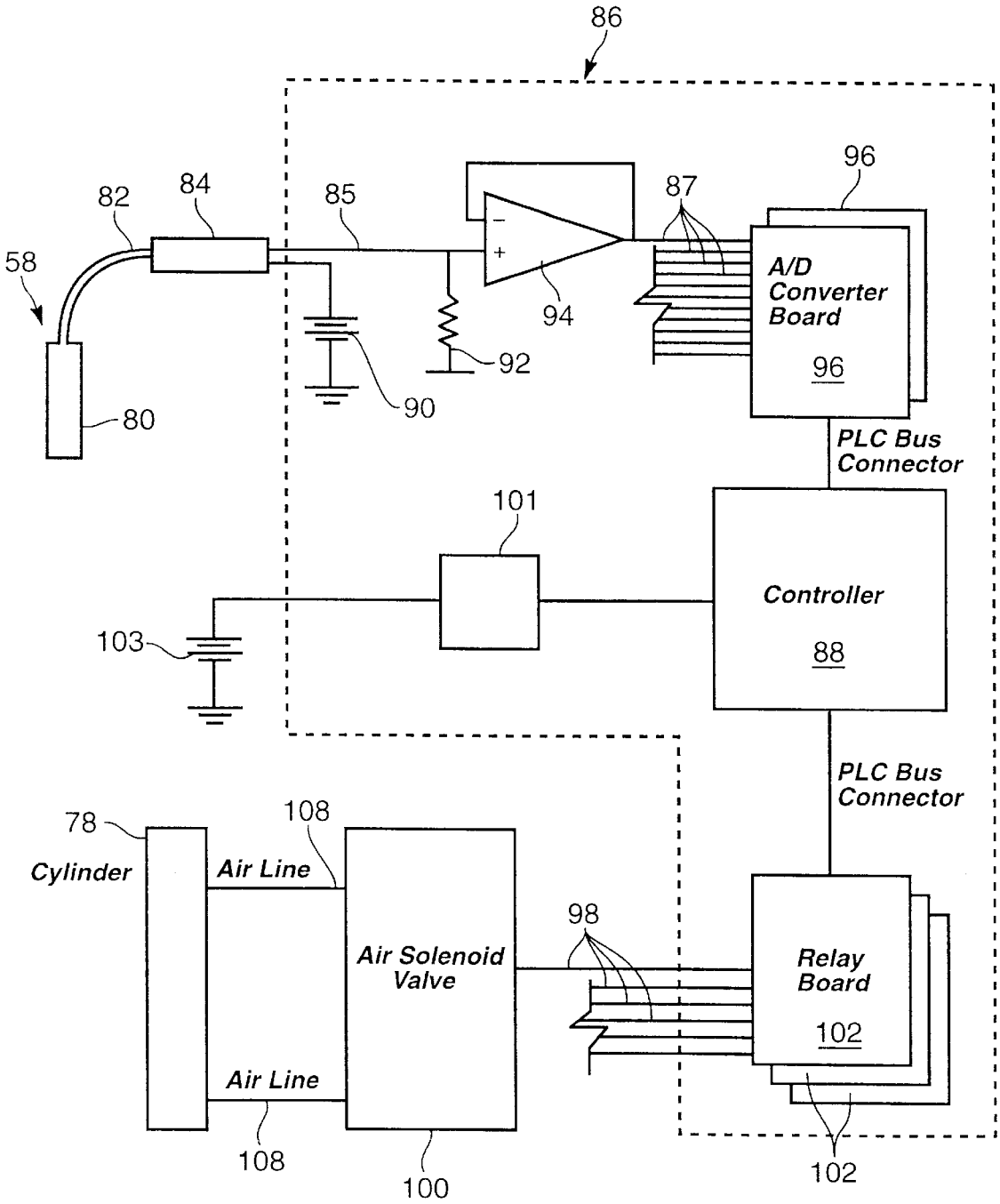
FIG. 5 is a schematic block diagram of one presently preferred embodiment of the present invention.

Reference is next made to FIG. 5, which illustrates in more detail one preferred embodiment of a schematic diagram derived from the block diagram of FIG. 4. Those of ordinary skill in the art will, of course, appreciate that various modifications to the detailed schematic diagram of FIG. 5 may easily be made without departing from the essential characteristics of the invention, as described in connection with the block diagram of FIG. 4 above. Thus, the following description of the detailed schematic diagram of FIG. 5 is intended only as an example, and it simply illustrates one presently preferred embodiment of a schematic diagram that is consistent with the foregoing description of FIG. 4 and the invention as claimed herein.

FIG. 5 is a schematic block diagram of the presently preferred embodiment of the present invention and illustrates one presently preferred embodiment of the sensing means, controlling means, and part of the dispensing means. In current design, there is a sensor 58 in front of each gate 38. In addition, an air cylinder 78 acts as an actuator for each gate 38 to open and close the gate 38. FIG. 5 depicts one sensor 58 and one air cylinder 78 for simplicity. The presently preferred design includes up to eighteen sensors 58 and eighteen air cylinders 78, all connected as shown in the schematic of FIG. 5.

The presently preferred sensors 58 are infrared thermocouples 80 that measure the temperature of the surface below the sensor. Particularly, the preferred sensors 80 are Exergen model IRt/c.3X-J-18OF/90C with a built in air purge and 3:1 mounting height to field of view ratio. Because most of the presently preferred gates 38 are each 12 inches (30.5 cm) wide, and because of the 3:1 mounting height to field of view ratio, each sensor 80 positioned over a 12-inch gate 38 is fixed approximately 36 inches (91.4 cm) above the road surface, as will be illustrated in FIG. 6. Those of skill in the art will appreciate that depending upon the width of the gate 38, the mounting height of the sensor 80 may vary. The output 82 of these sensors 80 is a variable analog voltage signal in the millivolt range. This signal 82 increases as the temperature of the surface increases and likewise decreases as the temperature of the surface decreases. As the temperature changes, the voltage level changes as well for each sensor 80.

For each sensor 80, the sensor signal is transmitted via thermocouple wire 82 out of the sensor 80. Connected to the thermocouple wire 82 is an in-line transmitter 84 which converts the analog millivolt signal so that it is in the range of four to twenty milliamps. The presently preferred transmitter 84 is an Exergen IRt/c.XMTR-J500. This 4–20 mA signal is then transmitted (as shown at 85) to a main controller box 86 via 18 gauge insulated wire. As shown in FIG. 5, a 12 V voltage supply 90 is also operably connected to the transmitter 84.

When the controller box 86 receives the signal from transmitter 84, it converts the analog 4–20 mA signal to an analog 0–2 V signal (as depicted at 87). This 0–2 V signal is then used by a programmable logic controller 88, once it has been digitized. Zero to Two Volts is the specified range of voltage inputs for each ADC on the A/D converter boards 96. Using an op amp 94 is desirable because this provides that the 0–2 V signal 87 is sent from a low resistance source, and it also provides that the the 4–20 mA signal 85 is fed into a constant load resistance.

In current design, the op amp 94 is configured as a unity-gain buffer or follower amplifier where $v_o=v_i$. In order to provide a 0–2 V signal 87 from a 4–20 mA signal, the signal 85 at the noninverting input of the op amp 94, $v_i$, would need to create a voltage of between 0–2 V. Accordingly, a resistor 92 appropriately calculated would provide such a voltage. In current design, a 100 Ω resistor is used such that $v_i$=(4–20 mA)*100, which translates to $v_i$=0.4 V up to 2 V. In current design, an LM324N op amp chip is used. The inverting input is connected to the output of the op amp 94 to create a voltage follower. The output of the op amp chip 94 will give a signal of 0.4 V to 2.0 V for a 4 mA to 20 mA signal from the transmitter 84 and will also be a low resistance voltage source.

The controller 88 used in the presently preferred embodiment is Programmable Logic Controller (PLC) 88 which is commercially available from Z-World Engineering as part number PK2120. The PLC 88 sequentially samples all eighteen of the analog voltage inputs from the sensors 80 by using analog to digital converters 96. In current design, one or more A/D converter boards 96 are used to convert the sensed signal from analog to digital. Particularly, Z-World Engineering XP 8500 analog to digital conversion boards 96 are used. These particular boards 96 are each capable of converting eleven signals from analog to digital. Accordingly, because the presently preferred aggregate spreader 10 may employ up to eighteen gates 38, two A/D converter boards 96 are used. Although for simplicity FIG. 5 only shows one signal 87 coming from an op amp 94 to the A/D boards 96, in the presently preferred embodiment there are eighteen signals 87 coming from eighteen op amps 94 being fed into the analog inputs of the A/D boards 96.

The XP 8500 boards 96 are connected to the PLC 88 through the PLC bus via a Z-World PLC bus connector. These boards 96 convert the analog 0–2 V signals to digital 0–2 V signals with 12 bits of accuracy. These boards 96 then send the digital 0–2.0 V signals to the PLC 88. In current design, each ADC on the A/D boards 96 has a different address. Each A/D converter board 96 has eleven channels, one channel for each ADC. To read each channel a different address is used.

After the PLC 88 has sampled all sensor signals 87, it then compares the signals to each other and groups the signals together according to their values. Signals having similar values are grouped together. The signals which are close to each other in value, i.e., having an approximate "common value," will indicate they are from sensors measuring surfaces with a "common temperature." If these surfaces with a "common temperature" are adjacent to each other, this indicates the material on these surfaces is the same for each surface. If there are other signals which vary from this common value this indicates they are from temperature measurements of surfaces with a different surface material than the surfaces with the "common temperature." One of the groups of values will be from temperature measurements with emulsified asphalt present and the other measurements will be from measurements with no emulsified asphalt present. From a previous calibration of the approximate temperature and location of the asphalt in relation to the chip spreader 10, the PLC 88 will determine which sensors indicate that binder is present and which do not. This process will be more fully described in relation to FIGS. 7–9.

Once the PLC 88 has determined where the asphalt binder is and where it is not, the PLC 88 will control the gates 38 over the binder to dispense aggregate, and it will cause those gates 38 over surfaces without binder to close so that no aggregate is deposited. The PLC 88 does this by sending signals to the gate actuators.

The PLC 88 sends a voltage signal 98 to an air solenoid valve 100 for each gate. In the presently preferred embodiment, this is accomplished by the PLC activating a relay for each gate 38. In current design, these relays are on Z-World XP 8300 relay boards 102 which are connected to and controlled by the PLC 88. The XP 8300 relay board 102 is connected to the PLC 88 through the PLC bus by means of a Z-World PLC bus connector. Presently, each XP 8300 relay board 102 has six relays. Accordingly, a total of three boards 102 are used to provide up to eighteen outputs. When activated, each relay sends a 12 V signal 98 to an air solenoid valve 100 via 18 gauge wire. In FIG. 5 only one air cylinder 78 and one air solenoid valve 100 are shown for the sake of simplicity, but in current design there are eighteen air cylinders 78 and eighteen air solenoid valves 100 where each valve 100 is connected to a relay from the relay boards 102. Each relay has a specific address. Each board 102 of relays is capable of being set (through jumpers) to distinguish addresses from the other boards 102. Functionality provided by the PLC board 88 and its compiler facilitate the changing of states of the individual relays.

In the presently preferred embodiment, the chip spreader may have up to eighteen gates 38. In current design, there is an air solenoid 100 for each gate 38. When a particular air solenoid 100 receives a signal 98 of 12 V, it releases the air pressure from the air cylinder 78 and the spring in the cylinder 78 then retracts the cylinder 78 and allows the gate 38 to open. When a particular air solenoid 100 receives a signal 98 of 0 V, it supplies air pressure to the air cylinder 78 and actuates the cylinder 78 causing the gate 38 to close. By opening or closing each individual gate 38 the system controls the placement of aggregate. Each air solenoid valve 100 controls a particular air cylinder 78 through air lines 108. As described, the actuators in the presently preferred embodiment are pneumatic. However, it will be appreciated by those skilled in the art that the actuators could be of different types, including electric, hydraulic, and the like.

The main controller box 86 houses the controller 88, the A/D boards 96, the relay boards 102, op amps 94, a power supply component 101 (described further below), the voltage supply 90, and other desirable electronic equipment (not shown). The main controller box 86 simply needs to be able to provide a place for these electronic components to be housed. Those skilled in the art will appreciate that many different configurations of containers, boxes, banks, and the like could be used to house the electronic equipment. In current design, the controller box 86 is simply a fiberglass container (not shown). In the bottom of the controller box 86 are threaded inserts. These threaded inserts are used to attach a metal plate to the bottom of the box 86 through screws. The different boards, including the PLC board, the A/D boards, and the relay boards, are all mounted to the metal plate with aluminum standoffs.

The controller 88, or PLC 88, gets power from the battery 103 of the chip spreader 10 through a filter 101. This filter 101 filters out transient signals and noise. In the presently preferred embodiment, the filter is available from Radio Shack as part number 270-151B. The other boards 96, 102 get their power from the PLC bus.

Figure 6:
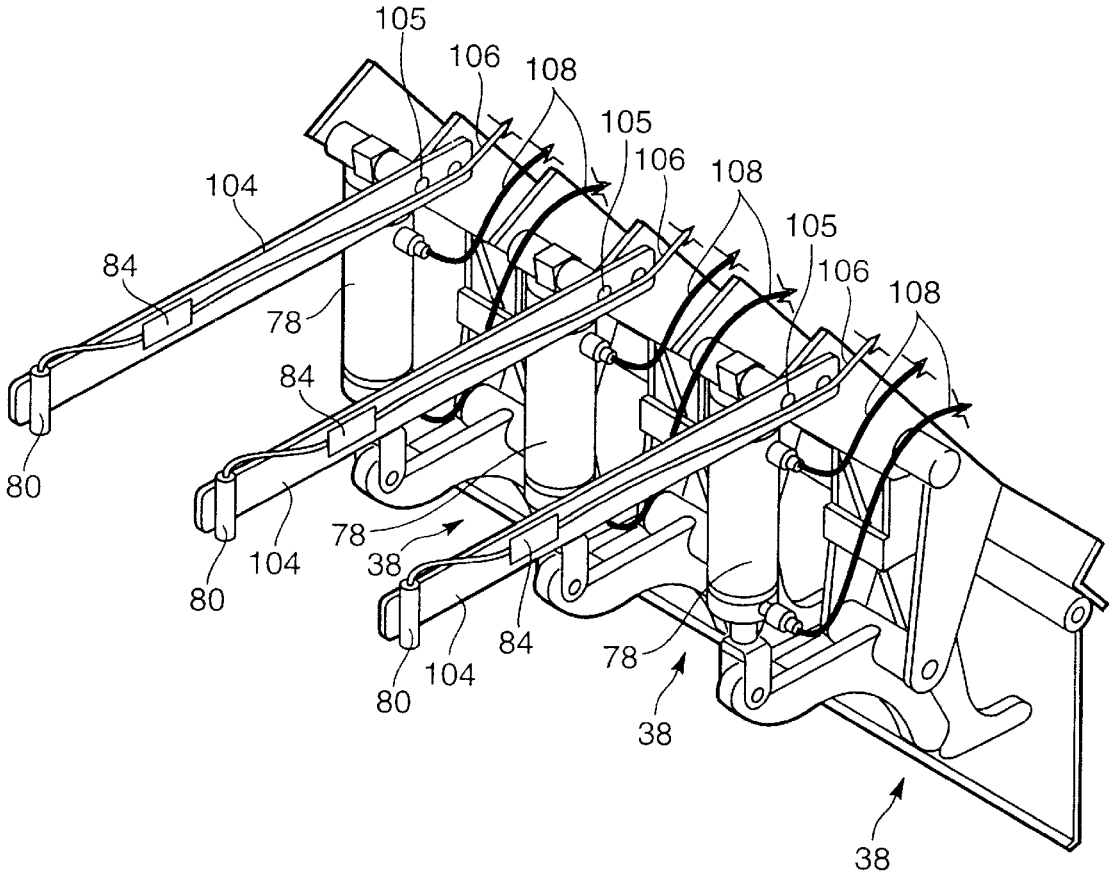
FIG. 6 is a perspective view of a portion of one presently preferred embodiment of the dispensing means showing its physical relationship with one presently preferred embodiment of the sensing means.

FIG. 6 shows several gates 38 of the present invention and the placement of the presently preferred sensors 80. In current design, an arm 104 is fixed to the upper portion of each gate 38. Specifically, the arm 104 is presently connected to the first hopper 12 at a top mounting bolt 105 of each air cylinder 78. For stability, the arm 104 extends past the top mounting bolt 105 of the air cylinder 78 where another bolt further secures the arm 104 to the first hopper 12.

The arm 104 extends forward and has one sensor 80 placed on its forward end. Also fixed to this arm 104 is the transmitter 84. In current design and as discussed earlier, the sensor 80 is positioned approximately 36 inches (91.4 cm) off the ground. FIG. 6 also illustrates the output line 106 coming from each transmitter 84. Also shown are the air lines 108 leading to each cylinder 78 from the solenoids 100 that cause the gate 38 to open or close. The air solenoid compartment 79 where all the air solenoids 100 are presently located is illustrated in FIG. 1.

Figure 7:
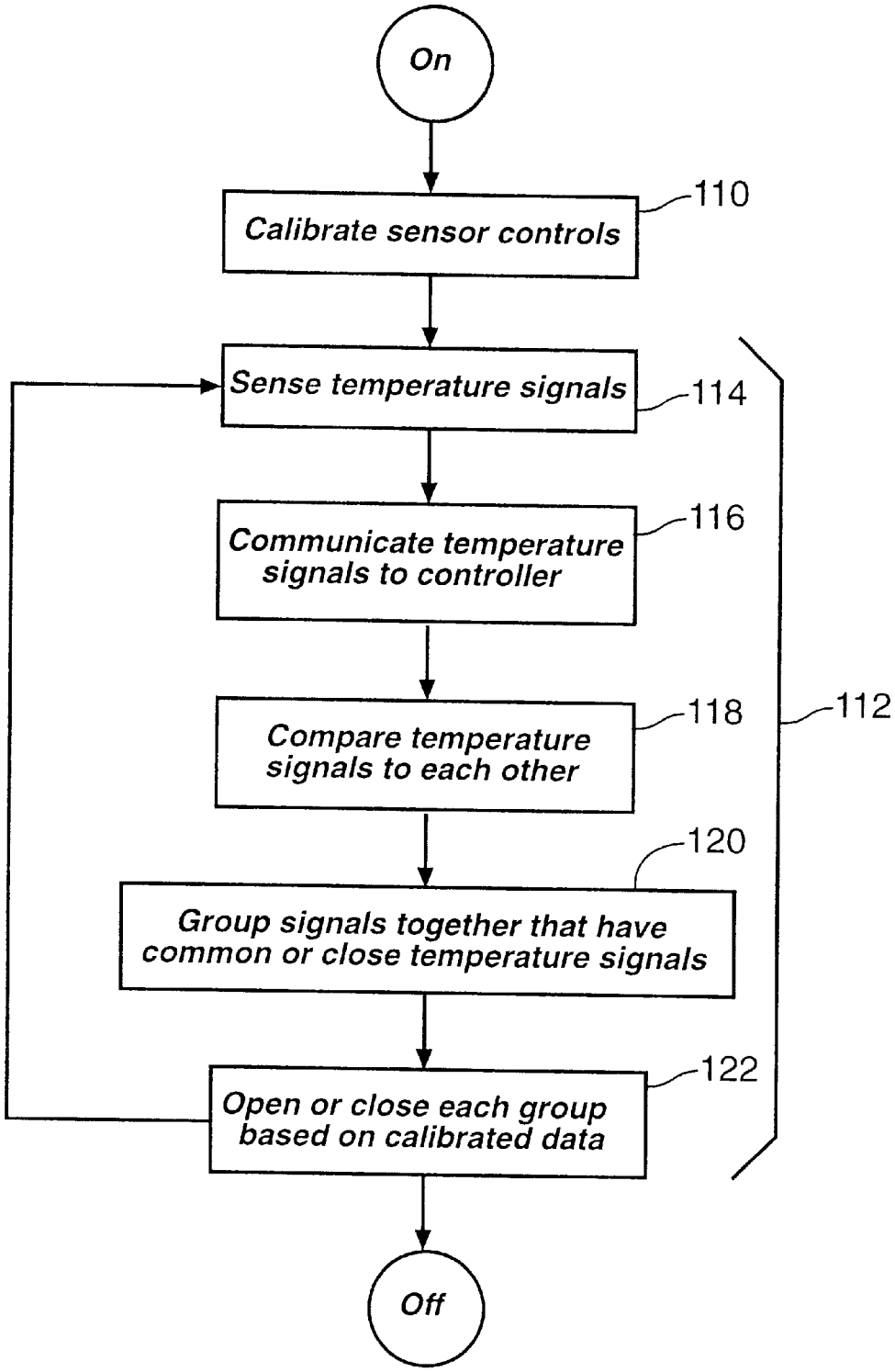
FIG. 7 is a general flow diagram illustrating the operation of one presently preferred embodiment of the present invention.

Referring now to FIG. 7, the present invention operates to detect where the binder, e.g., asphalt emulsion, is on the road surface 34 and then adjusts the dispensing means accordingly to dispense the loose aggregate onto the binder and avoid dispensing aggregate onto parts of the road having no binder. It will be appreciated by those skilled in the art that various approaches could be taken in accomplishing this invention. FIG. 7 is only meant as illustrative of the presently preferred embodiment of the present invention. The flow diagram shown in FIG. 7 could be modified in various ways and still be within the scope of the present invention.

When the present invention is first started, in current design, it is given calibration data to calibrate 110 the sensor control system. The approximate temperature and location of the asphalt binder in relation to the chip spreader is input to the controller 88. The controller 88 may then assign those temperature signals coming from the gates 38 over the asphalt binder as indicative that asphalt binder is present. In addition, the controller 88 may assign the other temperature signals coming from gates 38 not over binder as signals indicative that the respective gate 38 is not over binder. Once the controller 88 has this calibration data, it may determine a range of temperature signals that would indicate the presence of asphalt binder. If the temperature signal is not within that range, the controller 88, in current design, will assume that the signal comes from a gate 38 not over binder.

The controller 88 may then enter its main operation loop 112. The sensors 80 sense 114 the temperature signals from the road surface 34. Then these signals are communicated 116 to the controller 88. The controller 88 then compares 118 the temperature signals to each other. After the controller 88 has compared all the temperature signals, it groups 120 the signals together into a number of groups based on their closeness in relative temperature. In current design, the controller 88 operates under the assumption that the patch of binder placed on the roadway is continuous in its width. This is illustrated and discussed in relation to FIGS. 2 and 3.

Based upon the calibration data, the controller 88 then determines which group is the binder, and which, if any, groups are not over binder. The controller causes 122 the group over the binder to dispense aggregate, and any groups not over binder to close or remain closed. After it has made this determination, the present invention iterates through the main operating loop 112 again by sensing 114 temperature signals and communicating 116 them to the controller 88. It will be appreciated by those skilled in the art that the sensors 80 are continuously outputing a signal, and that this signal is being continuously communicated to a point where the controller 88 could poll it. The controller 88, in current design, is iterating through its control loop 112 while the sensors 80 are continuously sensing road surface characteristics.

Figure 8:
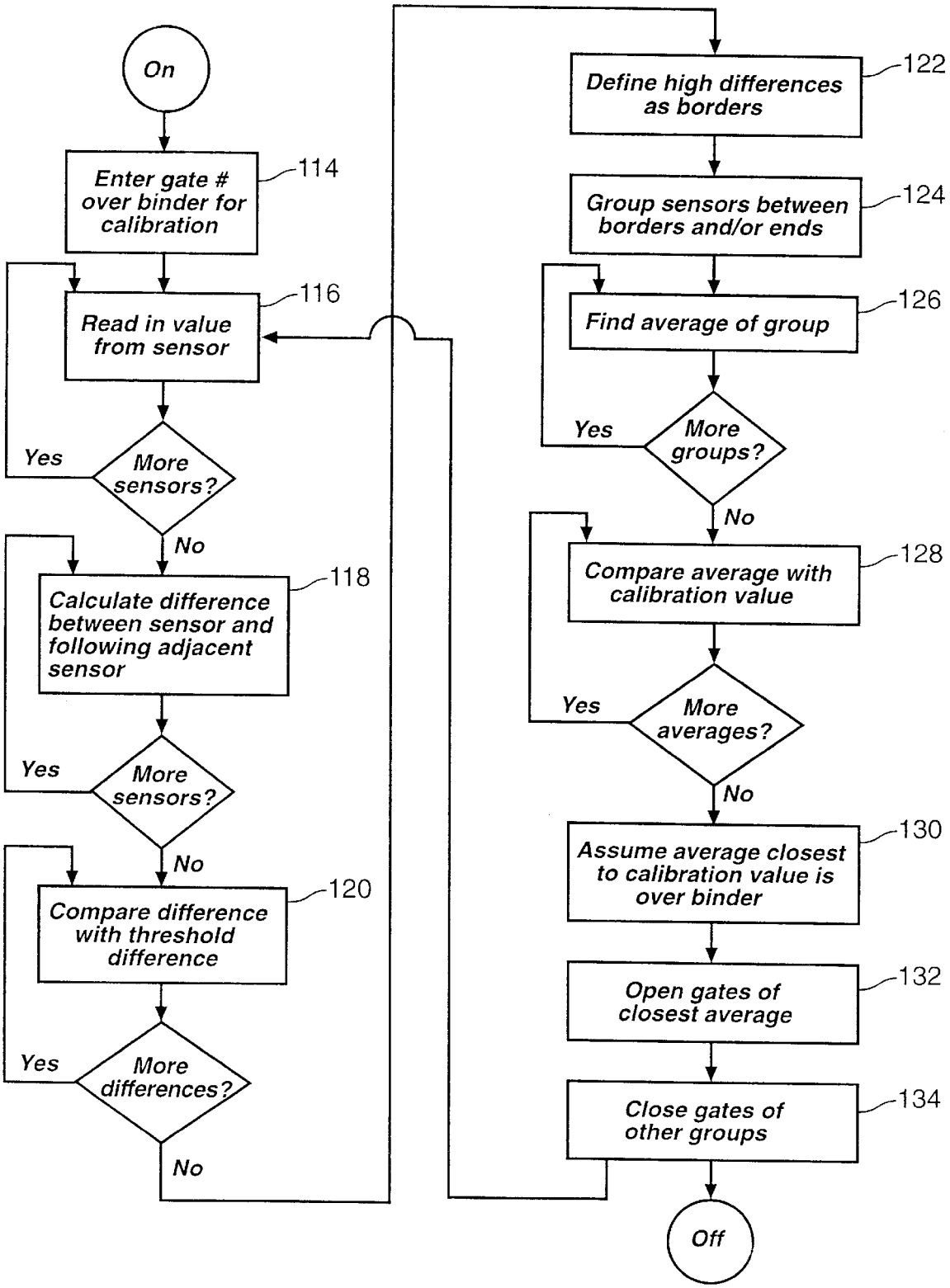
FIG. 8 is a more detailed flow diagram illustrating the operation of one presently preferred embodiment of the present invention.

In FIG. 8 a more detailed flow diagram is shown that describes the presently preferred method of operating the present invention. As with FIG. 7, various modifications could be made to the flow diagram of FIG. 8 without detracting from the scope of the present invention. As discussed, when the aggregate spreader 10 begins operation with the present invention, it first is calibrated for sensing the binder on the surface of the roadway. Presently, the aggregate spreader operator maneuvers the spreader 10 over a portion of binder and then enters 114 a gate 38 number positioned over binder into the PLC 88 through an input device 69. The PLC 88 then reads in the sensor value from that gate's sensor 80 and defines that signal as indicative of binder. Once this calibration is complete, the controller 88 enters it main operation loop.

The PLC 88 reads 116 in a value from a sensor 80. The signal from the sensor 80 presently is communicated through the components as shown and described in FIG. 5. As shown in FIG. 8, the PLC 88 will continue to iterate and read 116 in the sensor 80 signal values until all the sensor 80 signal values have been read in.

Once the PLC 88 has all the sensor 80 signal values, it calculates 118 the difference between each sensor value and the next succeeding sensor value. Accordingly, if there were eighteen gates 38 and eighteen sensors 80, there would be seventeen different values calculated. As shown, the presently preferred embodiment iterates in calculating 118 differences until it has cycled through all the sensor values.

The present invention uses a threshold difference value that is typically entered before operation of the present invention. This threshold difference is an indication of how big the difference between adjacent sensors 80 would need to be before the controller 88 would assume that the surface material has changed. The threshold difference may be calculated using the typical operational temperatures of a particular area and the specification sheets for the parts used in accomplishing the present invention. The threshold difference could also be empirically determined. Alternatively, the threshold could be set when the controller 88 is calibrated by inputing not only a gate 38 number over binder but a gate 38 number not over binder.

After the differences have been calculated 118, each difference is compared 120 with the threshold difference. As shown, the controller 88 iterates through all the difference values in comparing 120 the differences with the threshold difference. After the controller compares 120 the differences with the threshold, it then defines 122 any differences above the threshold as being borders. By borders is meant that the controller assumes those sensor values that created that difference value are assumed to be over different surfaces, i.e., one is assumed to be over binder and the other is assumed to be not over binder, thus there is a border between those sensors 80. The sensors 80 are then grouped 124 together according to where the borders are. Sensors 80 between borders are grouped 124 together, and sensors 80 between a border and an end are grouped 124 together.

Once grouping 124 has been accomplished, the controller finds 126 the average sensor value for each group. The controller iterates through all the groups until all the averages have been calculated 126. Once the averages have been calculated 126, the controller compares 128 each average with the calibration data. The controller 88 then assumes 130 that the average closest to the calibration data is the group presently over a portion of binder. The controller 88 then opens 132 (or permits to remain open) those gates 38 of that group with the average closest to the calibration data. The controller 88 also closes 134 those gates 38 of any other groups. After opening 132 and closing 134 the appropriate gates 38, the controller loops back to read in the next sampling of sensor values.

FIG. 9 is a data diagram that illustrates possible values that may be encountered and calculated when implementing the present invention as described in FIG. 8. The values given in FIG. 9 are only illustrative. Depending upon the particular area where the chip spreading is occurring, the temperature, the components being used on the chip spreader, the age of the components, the weather conditions, etc., the values could vary widely from the values shown in FIG. 9. The values used in FIG. 9 are the values that were read in by the PLC 88 from the A/D boards 96 as shown in FIG. 5. All values in FIG. 9 are in mV.

The illustrations shown in FIG. 9 illustrate several values. The calibration data 136 shows a possible value that may be obtained when calibrating the invention according to FIG. 8. S1 represents the sensor 80 for the first gate, S2 represents the sensor 80 for the second gate, and so on. As shown, for this illustration eighteen gates 38 and eighteen sensors 80 were used. In this illustration, the operator found gate number nine to be over binder and entered 114 this gate number through an input device 69. The value read in by the PLC 88 for this gate's sensor 80 was 898 mV. As a result, the calibration data to be referred to throughout operation of the present invention will be 898 mV.

The sample 138 of readings shows possible readings for each of the eighteen sensors 80. As shown, the signal values read in by the PLC 88 vary from 796 mV to 905 mV. The controller 88 obtains these values by reading 116 in values from the sensors 80 through the A/D boards 96.

The differences 140 show the differences between adjacent succeeding sensors 80. To illustrate, in current design D1=|S2−S1|, D2=|S3−S2|, D3=|S4−S3|, and so on. The differences are compared 120 with a threshold difference value 142. A possible threshold difference value is 25 mV. As discussed in relation to FIG. 8, any differences 140 higher than the threshold difference value 142 are defined 122 as borders. As a result, D3 and D15 are borders. The sensors 80 are then grouped 124 according to the borders and the ends (S1 and S18). With D3 and D15 being borders, there are three groups, a first group includes S1–S3, a second group includes S4–S15, and a third group includes S16–S18. The averages of each group are calculated 126, and the group with the average closest to the calibration data is assumed 130 to be over binder. With the possible values as shown in FIG. 9, it can be seen that the second group of S4–S15 has the average closest to the calibration data 136. The groupings 144 illustrate that the controller will open 132 gates four through fifteen, which correspond to S4–S15, and will close 134 the other gates, which correspond to S1–S3 and S16–S18.

The software that is used with the presently preferred embodiment may be developed through use of a compiler and linker purchased from Z-World Engineering. Z-World provides Dynamic C in which engineers may develop code for their device. Also provided by Z-World are many functions that enable engineers to accomplish tasks through their programming. The functionality provided by Z-World may be called upon through the function calls provided by Dynamic C. In current design, Dynamic C for Windows Deluxe Version 3.1 is being used.

Also commercially available is a connector which enables an IBM compatible PC to be connected to a PLC 88 enabling software to be downloaded from the computer to the PLC. The software available from Z-World includes utilities to download code into memory on the PLC 88 board, or to create a file from which a nonvolatile memory device could be programmed. The PLC 88 used with the present invention includes a socket for connecting such a device. In current design, once the software is ready for programming a nonvolatile storage device, an EPROM, is used and the software is burned into the EPROM.

It will be appreciated by those skilled in the art that the controller 88 may be used to accomplish many other tasks not directly related to the present invention. For example, the controller 88 could also be used to facilitate computerized application rate control for setting the amount of loose aggregate to be spread over the road surface.

From the above discussion, it will be appreciated that the present invention provides an aggregate spreader capable of selectively placing aggregate onto a road surface. The present invention enables an aggregate spreader to automatically sense where the binder or asphalt emulsion is on the road surface and to automatically select which part of the dispensing means should dispense aggregate to selectively place aggregate onto the binder.

The present invention also enables aggregate spreaders to substantially avoid the placement of excess aggregate onto a road surface when spreading aggregate. By substantially avoiding putting too much aggregate onto the road surface, the likelihood of injury or damage arising from placing excess aggregate onto the road surface may be reduced.

As explained earlier, before the chip sealing process can be applied, the surface needs to be substantially clean of excess aggregate. This often requires additional labor. The present invention may reduce the cost and time required in spreading aggregate by reducing the labor of cleaning off excess aggregate. The present invention also tends to reduce the likelihood of leaving bare asphalt emulsion on the road surface because of its ability to selectively place aggregate onto the binder. In addition, because of the features of the present invention, the skill and experience required by aggregate spreader operators is reduced because the spreader automatically places the aggregate where it should go without requiring the operator to continuously monitor the exact location of the binder on the road surface.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An aggregate spreader for spreading a layer of loose aggregate onto a road surface, the aggregate spreader comprising:

a first hopper for receiving the loose aggregate;

means associated with said first hopper for dispensing the loose aggregate onto the road surface;

means for sensing characteristics of the road surface, which characteristics comprises aggregate binder placed upon a portion of the road surface; and means responsive to said sensing means and operably associated with said dispensing means for controlling the placement of the layer of loose aggregate onto a substantial portion of the aggregate binder placed upon a portion of the road surface in an automated manner.

2. An aggregate spreader as defined in claim 1 wherein said sensing means comprises a heat sensor.

3. An aggregate spreader as defined in claim 1 wherein said sensing means comprises a plurality of heat sensors.

4. An aggregate spreader as defined in claim 1 wherein said sensing means comprises a photoelectric sensor.

5. An aggregate spreader as defined in claim 1 wherein said sensing means comprises a plurality of photoelectric sensors.

6. An aggregate spreader as defined in claim 1 wherein said sensing means comprises an optical sensor.

7. An aggregate spreader as defined in claim 1 wherein said sensing means comprises a plurality of optical sensors.

8. An aggregate spreader as defined in claim 1 wherein said sensing means comprises a temperature sensor.

9. An aggregate spreader as defined in claim 1 wherein said sensing means comprises a plurality of temperature sensors.

10. An aggregate spreader as defined in claim 1 wherein said sensing means comprises a displacement sensor.

11. An aggregate spreader as defined in claim 1 wherein said sensing means comprises a plurality of displacement sensors.

12. An aggregate spreader as defined in claim 1 wherein said sensing means comprises a plurality of thermocouple sensors.

13. An aggregate spreader as defined in claim 1 wherein said sensing means comprises a plurality of humidity sensors.

14. An aggregate spreader as defined in claim 1 wherein said sensing means comprises a video sensor.

15. An aggregate spreader as defined in claim 1 wherein said dispensing means comprises a plurality of gates.

16. An aggregate spreader as defined in claim 1 wherein said dispensing means comprises a plurality of gates, each of said gates being independently controllable by an associated means for actuating said gate.

17. An aggregate spreader as defined in claim 1 wherein said dispensing means comprises a plurality of gates, and wherein said controlling means selectively controls each of said gates.

18. An aggregate spreader as defined in claim 1 wherein said dispensing means comprises a plurality of discrete outlets.

19. An aggregate spreader as defined in claim 1 wherein said dispensing means comprises a variable width outlet.

20. An aggregate spreader as defined in claim 1 wherein said sensing means is positioned on a front end of said aggregate spreader.

21. An aggregate spreader as defined in claim 1 wherein said sensing means is positioned on said first hopper.

22. An aggregate spreader as defined in claim 1 wherein said sensing means senses characteristics of the road surface in front of said aggregate spreader.

23. An aggregate spreader as defined in claim 1 wherein said sensing means senses characteristics of the road surface proximate a front end of said aggregate spreader.

24. An aggregate spreader for spreading a layer of loose aggregate onto a road surface, said aggregate spreader having a front end and a back end, the aggregate spreader comprising:

a first hopper positioned proximate the front end of said aggregate spreader for receiving the loose aggregate;

a plurality of gates associated with said first hopper for dispensing the loose aggregate onto the road surface;

means for sensing characteristics of the road surface, which characteristics comprise aggregate binder placed upon a portion of the road surface; and means responsive to said sensing means and operably associated with said plurality of gates for controlling the placement of the layer of loose aggregate onto mostly a substantial portion of the aggregate binder placed upon a portion of the road surface by independently controlling each gate of the plurality of gates.

25. An aggregate spreader as defined in claim 24 wherein said sensing means comprises a plurality of heat sensors.

26. An aggregate spreader as defined in claim 24 wherein said sensing means comprises a plurality of photoelectric sensors.

27. An aggregate spreader as defined in claim 24 wherein said sensing means comprises a plurality of optical sensors.

28. An aggregate spreader as defined in claim 24 wherein said sensing means comprises a plurality of temperature sensors.

29. An aggregate spreader as defined in claim 24 wherein said sensing means comprises a plurality of displacement sensors.

30. An aggregate spreader as defined in claim 24 wherein said sensing means comprises a plurality of thermocouple sensors.

31. An aggregate spreader as defined in claim 24 wherein said sensing means comprises a plurality of humidity sensors.

32. An aggregate spreader as defined in claim 24 wherein said sensing means comprises a video sensor.

33. An aggregate spreader as defined in claim 24 wherein said sensing means comprises a plurality of video sensors.

34. An aggregate spreader as defined in claim 24 wherein said sensing means is positioned on said front end of said aggregate spreader.

35. An aggregate spreader as defined in claim 24 wherein said sensing means is positioned on said first hopper.

36. An aggregate spreader as defined in claim 24 wherein said sensing means senses characteristics of the road surface in front of said aggregate spreader.

37. An aggregate spreader as defined in claim 24 wherein said sensing means senses characteristics of the road surface proximate said front end of said aggregate spreader.

38. An aggregate spreader for spreading a layer of loose aggregate onto a road surface, said aggregate spreader having a front end and a back end, the aggregate spreader comprising:

a first hopper positioned proximate the front end of said aggregate spreader for receiving the loose aggregate;

a plurality of gates associated with said first hopper for dispensing the loose aggregate onto the road surface, each of said gates being independently controllable by an associated actuator;

means for sensing characteristics of the road surface, said sensing means being positioned at said front end of said aggregate spreader and the characteristics comprising asphalt binder placed upon a portion of the road surface; and an electronic controller in electronic communication with said sensing means and in electronic communication with a plurality of actuatovs for controlling the placement of the layer of loose aggregate onto mostly a substantial portion of the asphalt binder placed upon a portion of the road surface by independently controlling each gate of said plurality of gates.

39. An aggregate spreader as defined in claim 38 wherein said sensing means comprises a plurality of heat sensors.

40. An aggregate spreader as defined in claim 38 wherein said sensing means comprises a plurality of photoelectric sensors.

41. An aggregate spreader as defined in claim 38 wherein said sensing means comprises a plurality of optical sensors.

42. An aggregate spreader as defined in claim 38 wherein said sensing means comprises a plurality of temperature sensors.

43. An aggregate spreader as defined in claim 38 wherein said sensing means comprises a plurality of thermocouple sensors.

44. An aggregate spreader as defined in claim 38 wherein said sensing means senses characteristics of the road surface in front of said aggregate spreader.

45. An aggregate spreader as defined in claim 38 wherein said sensing means senses characteristics of the road surface proximate said front end of said aggregate spreader.

46. An aggregate spreader for spreading a layer of loose aggregate onto portions of a road surface having a binder material placed thereon, the aggregate spreader comprising:

a first hopper for receiving the loose aggregate;

means associated with said first hopper for dispensing the loose aggregate onto the road surface;

means for sensing the position of the binder material on the road surface; and means responsive to said sensing means and operably associated with said dispensing means for controlling the placement of loose aggregate onto the road surface such that loose aggregate is substantially placed onto said portions of the road surface having binder material placed thereon and such that placement of loose aggregate onto portions of the road surface having no binder material placed thereon is substantially avoided.

47. A method for spreading a layer of loose aggregate onto portions of a road surface having a binder material placed thereon, the method comprising the steps of:

obtaining a quantity of loose aggregate;

sensing the position of the binder material on the road surface;

dispensing the loose aggregate onto the road surface; and controlling the placement of loose aggregate onto the road surface such that loose aggregate is substantially placed onto said portions of the road surface having binder material placed thereon and such that placement of loose aggregate onto portions of the road surface having no binder material placed thereon is substantially avoided.

* * * * *

UNITED STATES PATENT AND TRADEMARK OFFICE

CERTIFICATE OF CORRECTION

PATENT NO. : 6,161,986 
DATED : December 19, 2000
INVENTOR(S) : Smith et al.

It is certified that error appears in the above-identified patent and that said Letters Patent is hereby corrected as shown below:

Title page,
Item [73], Assignee replace "Geff's" with -- Geffs --
Item [56], OTHER PUBLICATIONS, "Spread King The Model WHS Self-Propelled Chip Spreader", replace "pp. 1-7, U.S.A.," with -- pp. 1-7, 1997, U.S.A.. --

Column 6,
Line 53, insert -- a -- before "particular point along the roadway"

Column 7,
Line 27, replace "to not be" with -- not to be --
Line 30, replace "sameple" with -- sample --
Line 45, insert a comma (,) after "was binder 36"
Line 54, insert a comma (,) after "FIGS. 4 through 9"

Column 8,
Line 3, insert -- in -- after "used"
Line 15, delete "the" (second occurrence)
Line 43, insert -- 58 -- after "sensors"

Column 12,
Line 58, insert a comma (,) after "channel", second occurrence

Column 13,
Line 41, insert -- 10 -- after "spreader"
Line 50, insert a comma (,) after "each individual gate 38"

Column 14,
Line 29, insert a comma (,) after "compartment 79"
Line 30, insert a comma (,) after "located"

UNITED STATES PATENT AND TRADEMARK OFFICE

CERTIFICATE OF CORRECTION

PATENT NO. : 6,161,986
DATED : December 19, 2000
INVENTOR(S) : Smith et al.

It is certified that error appears in the above-identified patent and that said Letters Patent is hereby corrected as shown below:

Column 15,
Line 2, insert -- over -- after "is"
Line 30, replace "it" with -- its --

Column 20,
Line 6, replace "actuatovs" with -- actuators --

Signed and Sealed this

Thirteenth Day of August, 2002

*Attest:*

*Attesting Officer*

JAMES E. ROGAN
*Director of the United States Patent and Trademark Office*